United States Patent [19]

Franke et al.

[11] Patent Number: 4,795,376

[45] Date of Patent: Jan. 3, 1989

[54] INITIATOR TERMINAL BLOCK

[75] Inventors: Heinrich Franke; Horst Conrad, both of Detmold; Wolfgang Schild, Herford, all of Fed. Rep. of Germany

[73] Assignee: C. A. Weidmueller GmbH & Co., Detmold, Fed. Rep. of Germany

[21] Appl. No.: 165,343

[22] Filed: Feb. 29, 1988

Related U.S. Application Data

[63] Continuation of Ser. No. 928,844, Nov. 7, 1986, abandoned.

[30] Foreign Application Priority Data

Nov. 9, 1985 [EP] European Pat. Off. ..... 85114287.7

[51] Int. Cl.[4] ..... H01R 9/26

[52] U.S. Cl. ..... 439/715

[58] Field of Search ..... 439/715, 716, 717

[56] References Cited

U.S. PATENT DOCUMENTS 2,411,014 11/1946 Warnke ..... 339/198 R
4,270,835 6/1981 Kordt et al. ..... 339/198 A
4,647,141 5/1987 Muench et al. ..... 339/116 R

FOREIGN PATENT DOCUMENTS 3328666 2/1985 Fed. Rep. of Germany ... 339/198 R

*Primary Examiner*—Eugene F. Desmond
*Attorney, Agent, or Firm*—Laubscher & Laubscher

[57] ABSTRACT

An initiator terminal block for connecting a plurality of initiators with an electric power source, on the one hand, and with signal receivers, on the other hand, includes a plurality of terminal units each having a plurality of connecting locations arranged in three tiers situated above one another, each of the lower two tiers of each of the terminal units having only a single one of the connecting locations while the uppermost one of the tiers of each of the terminal units has two of the connecting locations that are electrically interconnected and are to be respectively electrically connected with the respective initiator and the respective signal receiver. Only one of the single connecting locations of each of the lower tiers of the terminal units is connected with the power source and the electric power supplied to this single connecting location is distributed by a transverse connector arrangement to all of the connecting locations of the terminal units that are arranged in the same tier for connecting the respective initiators thereat.

5 Claims, 1 Drawing Sheet

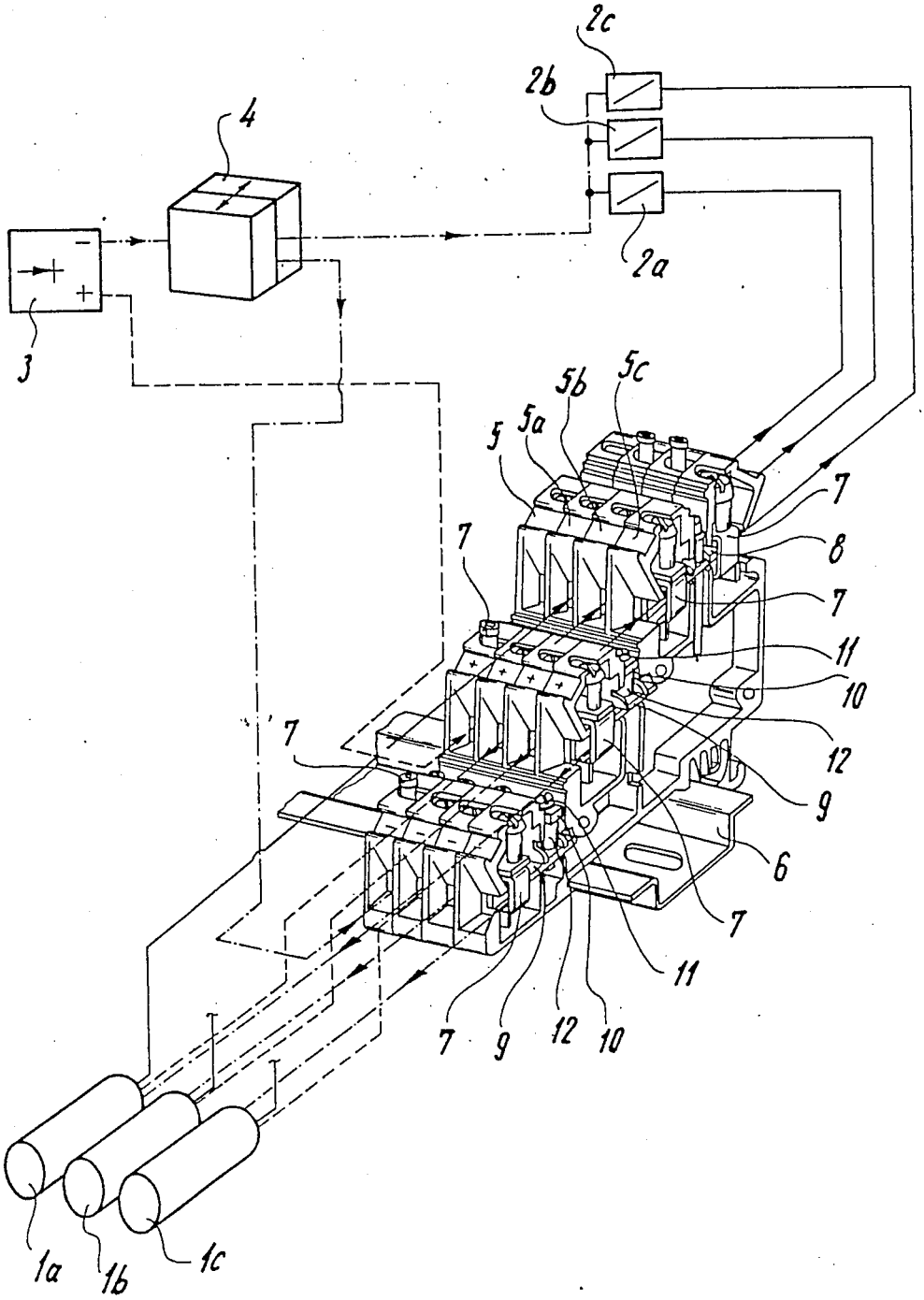
2c
2b
4
2a
3
5b
5c
5
5a
7
8
7
7
11
10
7
12
9
6
7
11
7
9
12
10
1a
1b
1c

INITIATOR TERMINAL BLOCK

This application is a continuation of application Ser. No. 06/928,844, filed 11/07/86, now abandoned.

BACKGROUND OF THE INVENTION

The present invention relates to electrical connecting arrangements in general, and more particularly to an initiator terminal block.

There are already known various constructions of electrical connecting arrangements of the type here under consideration, among them such which establish electrical connections between initiators and an electric power source, on the one hand, and the initiators and signal receivers, on the other hand and which will be referred to herein as initiator terminal block. In the heretofore known constructions of the initiator terminal blocks of this type, all of the circuit engineering connections for the respective initiator are executed in a respective single terminal unit of such a block in such a manner that the initiator in question is connected by means of its terminal unit through a corresponding number of supply conductors directly with an electric power source, while it is also connected by means of its terminal unit through respective control conductors with the associated signal receiver. As a result of this construction, there is encountered the requirement for providing each of the terminal units with a large number of connecting locations for the numerous supply and control conductors so that, even when the terminal units are constructed as three-tier terminal units, these terminal units are extremely long, since three connecting locations are needed both at the front side and at the rear side of the respective terminal unit, and these connecting locations are to be connected with one another at least in the respective tiers by current bars or similar electrically conductive elements. The establishment of the connections requires a considerable degree of attentiveness and skill, since both supply conductors and control conductors are to be connected at each of the two sides of the respective terminal unit.

SUMMARY OF THE INVENTION

Accordingly, it is a general object of the present invention to avoid the disadvantages of the prior art.

More particularly, it is an object of the present invention to provide an initiator terminal block which does not possess the drawbacks of the known terminal blocks of this type.

Still another object of the present invention is to devise a terminal block of the type here under consideration in which the terminal units constituting the terminal block occupy as little space as possible or feasible.

It is yet another object of the present invention to design the above terminal block in such a manner as to present a considerably simplified connecting possibility for the various electrical conductors.

A concomitant object of the present invention is so to construct the initiator terminal block of the above type as to be relatively simple in construction, inexpensive to manufacture, easy to use, and yet reliable in operation.

In keeping with these objects and others which will become apparent hereafter, one feature of the present invention resides in an initiator terminal block for connecting a plurality of initiators with an electric power source, on the one hand, and with signal receivers, on the other hand, this block comprising at least two terminal units each having a plurality of connecting locations arranged in three tiers situated above one another. Each of the lower two tiers of each of the terminal units has only a single one of the connecting locations while the uppermost one of the tiers of each of the terminal units has two of the connecting locations that are electrically interconnected and are to be respectively electrically connected with the respective initiator and the respective signal receiver. Only one of the single connecting locations of each of the lower tiers of the terminal units is connected with the power source and there is provided means including a transverse connector arrangement at each of the lower tiers for distributing the electric power supplied to the single connecting location of the respective tier to all of the connecting locations of the terminal units that are arranged in the same tier for connecting the respective initiators thereat.

Because of this construction, the rear connecting locations are totally eliminated at each of the two lower tiers of the individual terminal units of the initiator terminal block, so that the individual terminal units and thus the initiator terminal block assembled from such terminal units have a considerably shorter length than heretofore possible. On the other hand, the slight increase in the structural width of the block of this type, which results from the fact that the terminal unit which serves exclusively for the connection to the voltage source is to be considered to be an additional terminal unit with respect to the coupling of the initiators, does not have any adverse consequences. Despite the considerable shortening of the terminal units of the terminal block, there is still obtained a relatively large internal space which is available for the accommodation of circuit elements therein, since only a single connecting location is provided at the front side of each of the lower tiers of the individual terminal units. A terminal block of this kind also offers a good and very simple connecting possibility for the conductors, inasmuch as now all of the supply conductors, both those leading to and from the electric power or voltage source and those leading to and from the initiators are situated at one side of the initiator terminal block. Thus, in this construction, only the control conductors from the initiators are introduced into the connecting locations of the terminal units of the terminal block from one side of the terminal block, while associated extension control conductors exit from the connecting locations situated at the other side of the terminal units of the terminal block.

It is particularly advantageous when the transverse connector arrangement of each of the lower tiers includes respective short inwardly extending current bar elements provided with respective threaded holes, a transverse connector element extending over the connecting locations of the respective lower tier of all of the terminal units, and means for connecting the transverse connector element to the threaded holes. Such current bar elements extend only to a small extent into the interior of the insulating body but they render it possible, on the one hand, to reliably connect or mount the transverse connecting elements, as well as, on the other hand, to provide connections, for instance soldered connections, for electrically connecting electric circuit components which may be accommodated in the interior of the terminal units, since now a sufficient amount of internal space is available for the accommodation of such circuit components.

According to an advantageous aspect of the present invention, the connecting means of the transverse connector arrangement of each of the lower tiers further includes a plurality of screws and distancing sleeves which respectively electrically connect the transverse connector element with the current bar elements. Advantageously, there is further provided means at the uppermost tier of the terminal units for selectively interrupting the electrical interconnection between the two connecting locations of the upper tier of the respective terminal unit.

BRIEF DESCRIPTION OF THE DRAWING

The present invention will be below in more detail with reference to the sole FIGURE of the accompanying drawing which is a perspective view of an initiator terminal block according to the present invention and also depicts circuit engineering connections of the initiator terminal block with an electric power source, with respective initiators, and with respective associated signal receivers.

DETAILED DESCRIPTION OF THE PREFERRED EMBODIMENT

Referring now to the drawing in detail, it may be seen that the reference numerals la, lb and 1*c* have been used therein to identify three initiators each of which is to be connected in accordance with control engineering with an associated one of three signal receivers 2*a*, 2*b* and 2*c*. The signal receivers 2*a*, 2*b* and 2*c* may be constituted, for example, by relays which then respectively close an electric current supply line for a contactor on the basis of a signal of the corresponding associated initiator 1*a*, 1*b* or 1*c*.

The initiators 1*a*, 1*b* and 1*c* are supplied with an electric supply voltage derived from a voltage source 3, for instance a rectifier, through respective supply conductors which are indicated in the drawing by dashed lines for the positive voltage (+) and by dash-dotted lines for the negative voltage (−). The signal receivers or relays 2*a*, 2*b* and 2*c* are also coupled with the voltage source 3 through a distributor 4.

Now, for effectuating the required circuit engineering connections, the illustrated initiator terminal block includes altogether four individual terminal units 5, 5*a*, 5*b* and 5*c*. The terminal units 5, 5*a*, 5*b* and 5*c* are arranged next to one another on a standardized carrier rail 6 and are arrestingly connected the rail 6. Herein, each of the terminal units 5, 5*a*, 5*b* and 5*c* has three steps or tiers. Each of the terminal units 5, 5*a*, 5*b* and 5*c* has at its lower two tiers only a single connecting location which is constituted in the illustrated construction by a screw connector 7. Only the uppermost one of the tiers of each of the terminal units 5, 5*a*, 5*b* and 5*c* is provided with two connecting locations. In the illustrated construction, the connecting locations of the uppermost tier of each of the terminal units 5, 5*a*, 5*b* and 5*c* are again constituted by respective screw connectors 7 which are connected with one another in a customary manner by a current bar 8.

On the other hand, transversely extending coupling connections are associated with the single connectors 7 at the two lower tiers of the terminal units 5, 5*a*, 5*b* and 5*c*. In the illustrated construction, these coupling connections are constituted by relatively short current bar elements 9 which are respectively associated with the respective screw connectors 7 and which extend only to a relatively small extent into the interior of the terminal units 5, 5*a*, 5*b* and 5*c* so that, as depicted in the drawing, a relatively voluminous free internal space, in which circuits and their structural components can be additionally accommodated, is provided in the terminal units 5, 5*a*, 5*b* and 5*c* despite their relatively small length.

The current bar elements 9 can also be utilized for the connection thereat, for instance by means of soldered joints, of any circuits and their structural components which may be accommodated in the internal space of the terminal units 5, 5*a*, 5*b* and 5*c*.

The current bar elements 9 further serve for mounting internally located transverse connectors 10 for the two lower tiers, these transverse connectors 10 extending across the terminal units 5, 5*a*, 5*b* and 5*c* of the initiator terminal block. To this end, the current bar elements 9 are provided with threaded bores into which screws 11 which extend through the transverse connectors 10 as well are threaded. The transverse connectors 10 are spaced by a predetermined distance from the current bar elements 9, this distance being maintained by respective electrically conductive spacing sleeves 12 which bridge this distance.

Now, the circuit engineering coupling of the initiators 1*a*, 1*b* and 1*c* with the voltage source 3 is accomplished in such a manner that only one terminal unit 5 of the initiator terminal block, to the exclusion of the remaining terminal units 5*a*, 5*b* and 5*c*, is directly connected by corresponding conductors with the voltage source 3. The supply voltage for the three initiators 1*a*, 1*b* and 1*c* is then distributed, commencing with the one terminal unit, 5 of the, initiator terminal block, through the transverse connection constituted by the components 10, 11 and 12 and the current bar elements 9 to the other terminal units 5*a*, 5*b* and 5*c* which are individually associated with the respective initiators 1*a*, 1*b* and 1*c*. Then the respective initiators 1*a*, 1*b* and 1*c* are correspondingly connected to the lower tiers of the associated terminal units 5*a*, 5*b* and 5*c*, as indicated by respective dashed and dash-dotted lines and associated arrows.

What results herefrom is that all of the supply conductors, whether they conduct electric current toward or away from the initiator terminal block, are situated only at one side of the initiator terminal block.

Only at the uppermost tier of the initiator terminal block are control conductors from the initiators 1*a*, 1*b* and 1*c*, which are indicated by solid lines that have been partially omitted to avoid cluttering of the drawing and possible confusion and by associated arrows, introduced into the corresponding terminal units 5*a*, 5*b* and 5*c* of the initiator terminal block at the one side, while corresponding continuation control conductors leading to the respective signal receivers 2*a*, 2*b* and 2*c* exit the terminal units 5*a*, 5*b* and 5*c* at the other side of the initiator terminal block.

In accordance with a further development according to the present invention, there may be provided in the uppermost tiers of the corresponding terminal units 5*a*, 5*b* and 5*c* of the initiator terminal block respective separation members disposed respectively between the two associated connecting locations and operative for interrupting or disconnecting the respective control current circuit.

While the present invention has been described and illustrated herein as embodied in a specific construction of an initiator terminal block, it is not limited to the details of this particular construction, since various modifications and structural changes are possible and contemplated by the present invention. Thus, the scope of the present invention will be determined exclusively by the appended claims.

What is claimed is:

1. An initiator circuit arrangement comprising, in combination a plurality of initiators;

an electric power source;

a plurality of signal receivers;

a multitude of first supply conductors and a multitude of second supply conductors, a different supply conductor of each of said multitudes being connected to each of said initiators and to said power source;

a plurality of first control conductors and a plurality of second control conductors, a different control conductor of one of said pluralities being connected to each of said initiators and a different control conductor of the other of said pluralities being connected to each of said signal receivers; and a terminal block including a multitude of terminal units, each of said terminal units having a plurality of connecting locations arranged in three tiers situated above one another, each of the lower two tiers of each of said terminal units having only a single one of said connecting locations, each of said connecting locations of one of said lower two tiers being connected to a different one of said supply lines of one of said multitudes, and each of said connecting locations of the other of said lower two tiers being connected to a different one of said supply lines of the other of said multitudes, the uppermost one of said tiers of each of said terminal units having two of said connecting locations that are electrically interconnected, each of said first control conductors being connected to one and the associated one of said second conductors being connected to the other of said two connecting locations of the respective one of said terminal units; and connecting means including a separate transverse connector arrangement at each of said two lower tiers for distributing the electric power supplied from said electric power source to one of said connecting locations of the respective lower tier to all remaining ones of said connecting locations of said terminal units that are arranged in the same tier.

2. An initiator circuit arrangement comprising, in combination a plurality of initiators;

an electric power source;

a plurality of signal receivers;

a multitude of first polarity supply conductors and a multitude of second polarity supply conductors, a different supply conductor of each of said multitudes being connected to each of said initiators and to said power source;

a plurality of first control conductors and a plurality of second control conductors, a different control conductor of one of said pluralities being connected to each of said initiators and a different control conductor of the other of said pluralities being connected to each of said signal receivers; and a terminal block including a multitude of identical terminal units, each having a plurality of connecting locations arranged in three tiers situated above one another, each of the lower two tiers of each of said terminal units having only a single one of said connecting locations, the number of said terminal units in the terminal block being greater by one than that of said initiators in said plurality so that each of said first polarity conductors associated with said initiators and with said electric power source is connected to a different one of said connecting locations of one of the two lower tiers of said terminal block, and each of said second polarity conductors associated with said initiators and with said electric power source is connected to a different one of said connecting locations of the other of the two lower tiers of said terminal block, the uppermost of said tiers of each of said terminal units having two of said connecting locations facing in opposite directions and electrically connected with one another, one of said first control conductors being connected to one, and one of said second control conductors being connected to the other of said two connecting locations of said uppermost tier of the respective one of said terminal units of the terminal block; and means for separately electrically interconnecting said connecting locations of all of said terminal units in each of said two lower tiers, including a transverse connector arrangement in said terminal block at each of said two lower tiers.

3. An initiator terminal block for connecting respective first and second polarity supply conductors of each of a plurality of initiators with corresponding first and second polarity conductors of an electric power source, on the one hand, and a control conductor of each initiator with a control conductor of an associated signal receiver, on the other hand, comprising in combination a multitude of identical terminal units, each having a plurality of connecting locations arranged in three tiers situated above one another, each of the lower two tiers of each of said terminal units having only a single one of said connecting locations, the number of said terminal units in the terminal block being greater by one than that of the initiators in the plurality for connection of the first polarity conductors of the initiators and of the electric power source each to a different one of said connecting locations of one of the two lower tiers of the terminal block, and for connection of the second polarity conductors of the initiators and of the electric power source each to a different one of said connecting locations of the other of the two lower tiers of the terminal block, the uppermost of said tiers of each of said terminal units having two of said connecting locations facing in opposite directions and electrically connected with one another for connection of the control conductors of each initiator and of the associated signal receiver to a different one of said two connecting locations of a different one of said terminal units of the terminal block, and means for separately electrically interconnecting said connecting locations of all of said terminal units in each of said two lower tiers, including a transverse connector arrangement in said terminal block at each of said two lower tiers.

4. The initiator terminal block as defined in claim 3, wherein said transverse connector arrangement of each of said lower tiers includes respective short inwardly extending current bar elements provided with respective threaded holes, a transverse connector element extending over s[aid connecting locations of the respective lower tier of all of said terminal units, and means for connecting said transverse connector element to said threaded holes.

5. The initiator terminal block as defined in claim 4, wherein said connecting means of said transverse connector arrangement of each of said lower tiers further includes a plurality of screws and distancing sleeves which respectively electrically connect said transverse connector element with said current bar elements.

* * * * *